United States Patent [19]

Kamei et al.

[11] Patent Number: 4,653,449

[45] Date of Patent: Mar. 31, 1987

[54] APPARATUS FOR CONTROLLING OPERATING STATE OF AN INTERNAL COMBUSTION ENGINE

[75] Inventors: Eiichi Kamei, Nagoya; Hideaki Namba, Oobu; Mitsunori Takao, Kariya; Masahiro Ohba, Okazaki; Masao Yonekawa, Kariya; Masashi Kiyono, Anjo, all of Japan

[73] Assignee: Nippondenso Co., Ltd., Kariys, Japan

[21] Appl. No.: 810,566

[22] Filed: Dec. 19, 1985

[30] Foreign Application Priority Data

Dec. 19, 1984 [JP] Japan ..... 59-267765

[51] Int. Cl.[4] ..... F02M 3/00; F02M 51/00

[52] U.S. Cl. ..... 123/478; 123/339

[58] Field of Search ..... 123/478, 492, 493, 325, 123/326, 340, 341, 349, 352

[56] References Cited

U.S. PATENT DOCUMENTS

| | | | |
|---|---|---|---|
| 4,418,673 | 12/1983 | Tominari et al. | 123/478 |
| 4,465,051 | 8/1984 | Hasegawa | 123/478 |
| 4,492,195 | 1/1985 | Takahashi et al. | 123/339 |
| 4,492,202 | 1/1985 | Murumatsu et al. | 123/478 |
| 4,501,400 | 12/1985 | Hattori | 123/478 |
| 4,513,721 | 4/1985 | Ina et al. | 123/478 |
| 4,524,745 | 6/1985 | Tominari et al. | 123/478 |
| 4,552,116 | 11/1985 | Kurawa et al. | 123/478 |
| 4,553,518 | 11/1985 | Takao et al. | 123/478 |
| 4,573,443 | 3/1986 | Watanabe et al. | 123/478 |

*Primary Examiner*—Raymond A. Nelli

*Attorney, Agent, or Firm*—Cushman, Darby & Cushman

[57] ABSTRACT

Apparatus for controlling the operating state of an internal combustion engine (M1), has a demand amount detecting an unit (M2) for detecting amount of demand to the engine, an operating condition varying unit (M3) for varying a condition of operation of the engine, an operating state detecting an unit (M4) for detecting operating state of the engine, a target value setting unit (M5) for determining target values of variables of the operating condition, a control unit (M6) for controlling the operating condition varying unit (M3) by determining feedback amount of the operating condition variables so that detected values equal to the target values. In such apparatus, the target value setting unit (M5) is constructed to determine a target intake air quantity as a value with which fuel supply amount becomes minimum on the basis of the correlation between intake air quantity and fuel supply amount when output torque is made constant, and the control unit (M6) is constructed as an integral-added optimal regulator which determines the feedback amount on the basis of an optimal feedback gain predetermined in accordance with dynamic model of a system relating to the operation of the internal combustion engine.

7 Claims, 12 Drawing Figures

APPARATUS FOR CONTROLLING OPERATING STATE OF AN INTERNAL COMBUSTION ENGINE

BACKGROUND OF THE INVENTION

This invention relates to an operating state control apparatus for an internal combustion engine, and more particularly, to an apparatus for controlling an operating state of an internal combustion engine, the operating state including at least output torque and intake air quantity of an internal combustion engine. These operating states are satisfactorily controlled on the basis of a dynamic model of the system relating to the operation of the internal combustion engine.

An internal combustion engine, as a prime mover, must stably realize a desired output in response to the manipulation of a driver. There is a tendency for the control of an internal combustion engine to be electronically performed so as to improve fuel consumption and realize a stable engine output.

Taking an air/fuel ratio control of an internal combustion engine in which a fuel injection amount is controlled as one example of such control, the control is performed, as in the fuel injection amount control apparatus whose structure is schematically shown in FIG. 2, according to classic feedback control theory. Namely, while the intake air quantity Q of an internal combustion engine E/G is determined by the opening degree of a throttle valve TH which opens and closes in response to an accelerator, a basic fuel injection amount Tp is obtained as $Tp=K\times Q/N$ (wherein K is a constant) on the basis of a load of the internal combustion engine E/G, this load being determined as Q/N from the above-mentioned intake air quantity Q and rotational speed N. Then, this basic fuel amount Tp is feedback controlled using a feedback correction factor F (A/F) and so on which is determined by a detection signal from means for detecting an air/fuel ratio of the intake air, such as an oxygen concentration sensor $O_2$ provided to an exhaust system of the internal combustion engine E/G, and then a fuel injection amount $\tau$ for realizing target air/fuel ratio is obtained.

However, the apparatus for controlling the operating state of an internal combustion engine using such prior art techniques have suffered from the following problems.

(1) In normal internal combustion engines, the quantity of intake air is controlled by the opening degree of the throttle valve which is linked with the accelerator, and a fuel amount suitable for intake air quantity is mixed with the intake air by way of a carburettor or a fuel injection valve. Therefore, the output torque and fuel consumption amount are simply determined by only the operated stroke of the accelerator, and thus it has been impossible to precisely control fuel amount to a necessary output torque. In order to reduce fuel consumption amount, therefore, a way of control has been adopted so as to provide a lean air/fuel ratio in accordance with the operating state of the internal combustion engine.

However, when the air/fuel ratio is made large so that a lean air/fuel ratio mixture is combusted to improve fuel consumption of an internal combustion engine, there arises a problem that the output torque of the internal combustion engine drastically varies due to the variation of fuel supply amount caused from the air/fuel ratio control. FIG. 3 is a graph showing the relationship between air/fuel ratio A/F and output torque T of an internal combustion engine when comparing a large air/fuel ratio region with a small air/fuel ratio region, the variations $\Delta Tr$ and $\Delta Tl$ of the output torque T with respect to the variation in air/fuel ratio A/F can be found, as shown. The variation $\Delta Tl$ in the large air/fuel ratio region is larger than the $\Delta Tr$ in the small air/fuel ratio range. This means that engine operation when operating with a large air/fuel ratio (that is—a large numer), i.e. with a lean mixture, results in an unstable output torque. Namely, to stabilize the output torque during the operation in lean air/fuel ratio range has essentially been difficult using conventional feedback control in which a fuel supply amount is controlled in accordance with a detected concentration of oxygen in the exhaust system.

(2) As long as the control is performed such that fuel supply amount is determined on the basis of detected intake air quantity of an internal combustion engine, there necessarily occurs a time lag in the fuel supply amount control. Therefore, when intake air quantity is increased by steping onto the accelerator for acceleration, there arises a problem that output torque of the internal combustion engine first rises followed by the air/fuel ratio becoming lean, thereby generating a lean spike. This problem appears during deceleration to cause a rich spike to appear in the air/fuel ratio. In either case there arises a problem that a satisfactory acceleration/deceleration characteristic cannot be obtained because the reverse swing phenomenon occurs in the output torque characteristic required to the internal combustion engine.

Examples of such lean spike and rich spike are shown in FIG. 4.

(3) To solve the problem of the above-mentioned (2), an internal combustion engine control apparatus can be conceived (for example, "Accelerator Control Apparatus for Vehicles" disclosed in Patent Provisional Publication No. 59-122743) in which fuel supply amount is increased first when the accelerator is depressed, and then the intake air quantity is increased by opening the throttle valve with an arrangement that the throttle valve, which has conventionally been linked with the accelerator, is driven by way of an actuator. However, the control of the opening degree of the throttle valve encounters the following problems in connection with response and stability. Namely, in the conventional feedback control, in which controlled variables of an actuator is determined in accordance with the deviation of an actual opening degree from a target opening degree, if feedback gain is increased to increase the amount of feedback so as to provide a good driving feeling to the vehicle driver with the response of the control system being enhanced, excessive control would result and overshooting and/or downshooting would occur. On the other hand, if the amount of feedback is reduced to realize a stable control of intake air quantity, the follow-up characteristic is deteriorated and the driving feeling would be unsatisfactory. In this way, there is a contradiction in the conventional feedback control.

For this reason, therefore, the simple structure for controlling the throttle valve opening degree by way of an actuator or the like does not provide a perfect solution.

(4) On the other hand, as one method of controlling an internal combustion engine, an idea of controlling the internal combustion engine precisely using dynamic models of the internal combustion engine formed through so called modern control theory was proposed. This idea contemplates a providing stable control of output torque and air/fuel ratio with satisfactory response using parameters which are determined by dynamic models of the internal combustion engine using target output torque and target air/fuel ratio which are set from an amount of damands to the internal combustion engine. However, a response suitable for a given target value is just realized on the basis of dynamic models, and therefore, no control of minimizing fuel consumption is effected.

The present invention has been made so as to solve the problems in the above-mentioned (1) through (4), and contemplates providing an apparatus for controlling an operating state of an internal combustion engine with which apparatus engine output torque shows desired response and stability while fuel consumption amount can be made minimum.

SUMMARY OF THE INVENTION

The present invention has been developed in order to remove the above-described drawbacks inherent to the conventional apparatus for controlling operating state of an internal combustion engine.

It is, therefore, an object of the present invention to provide a new and useful apparatus for controlling operating state of an internal combustion engine with which quick response and high stability in operation are obtained, while output torque of the engine is controlled to a desired target value consuming minimum amount of fuel.

According to a feature of the present invention the occurrence of lean spike and rich spike is effectively suppressed so as to provide a comfortable drive feeling to a vehicle driver of a motor vehicle whose engine is controlled according to the present invention.

In accordance with the present invention there is provided apparatus for controlling operating state of an internal combustion engine comprising: demand amount detecting means M2 for detecting demand amount including at least the manipulation amount of an accelerator as an amount of damand for the operation of said internal combustion engine M1; operating condition varying unit or means M3 for varying variables of operating condition including at least fuel supply amount and throttle valve opening degree as conditions of operation of said internal combustion engine M1; operating state detecting unit or means M4 for detecting variables of operating state including at least intake air quantity, rotational speed and output torque as the operating state of said internal combustion engine M1; target value setting unit or means M5 for determining respective target values of operating state variables including at least target output torque and target intake air quantity using said demand amount detected; control unit or means M6 for controlling said operating condition varying unit or means by determining feedback amount of said operating condition variables so that variables of the detected operating state of said internal combustion engine M1 are equal to said determined target values; characterized in that said target value setting unit or means M5 is constructed such that said target intake air quantity is determined as an intake air quantity with which said fuel supply amount becomes minimum on the basis of the correlation between intake air quantity and fuel supply amount when output torque is made constant; and in that said control unit or means M6 is constructed as an integral-added optimal regulator which determines said feedback amount on the basis of an optimal feedback gain predetermined in accordance with dynamic model of a system relating to the operation of said internal combustion engine M1.

BRIEF DESCRIPTION OF THE DRAWINGS

The object and features of the present invention will become more readily apparent from the following detailed description of the preferred embodiments taken in conjunction with the accompanying drawings in which.

The same or corresponding elements and parts are designated at like reference numerals throughout the drawings.

DETAILED DESCRIPTION OF THE INVENTION

Figure 1:
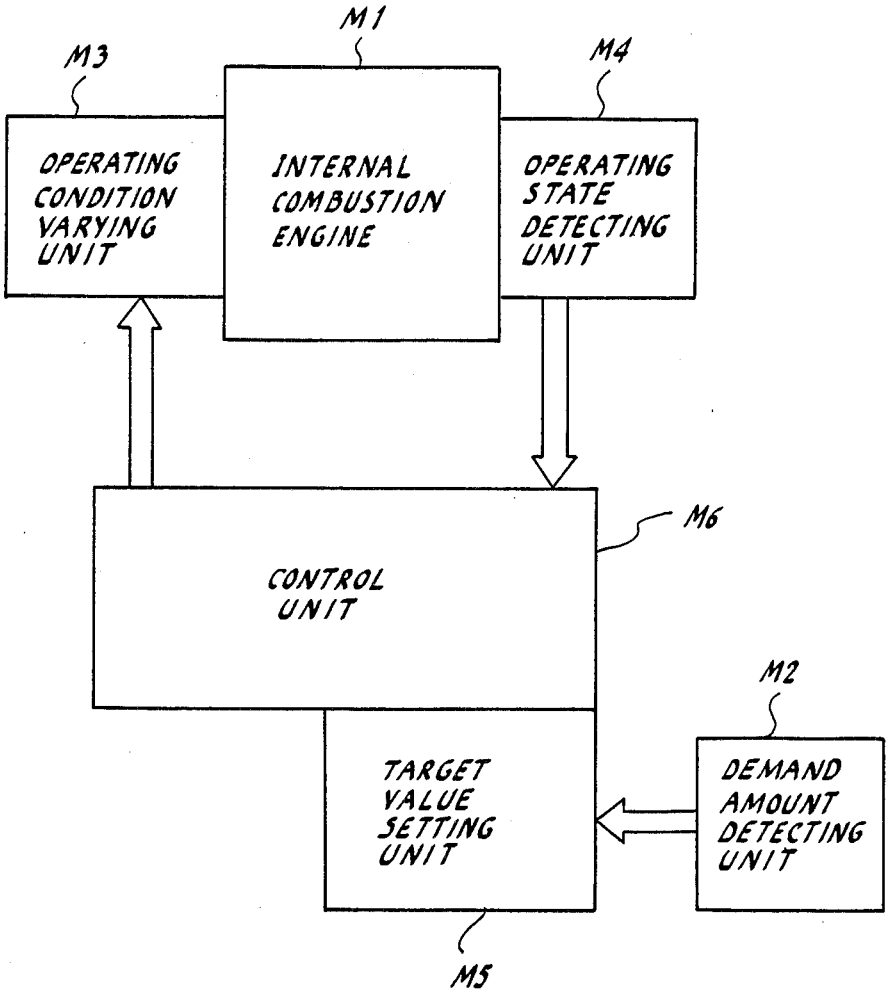
FIG. 1 is a basic structual diagram of the present invention.
Figure 2:
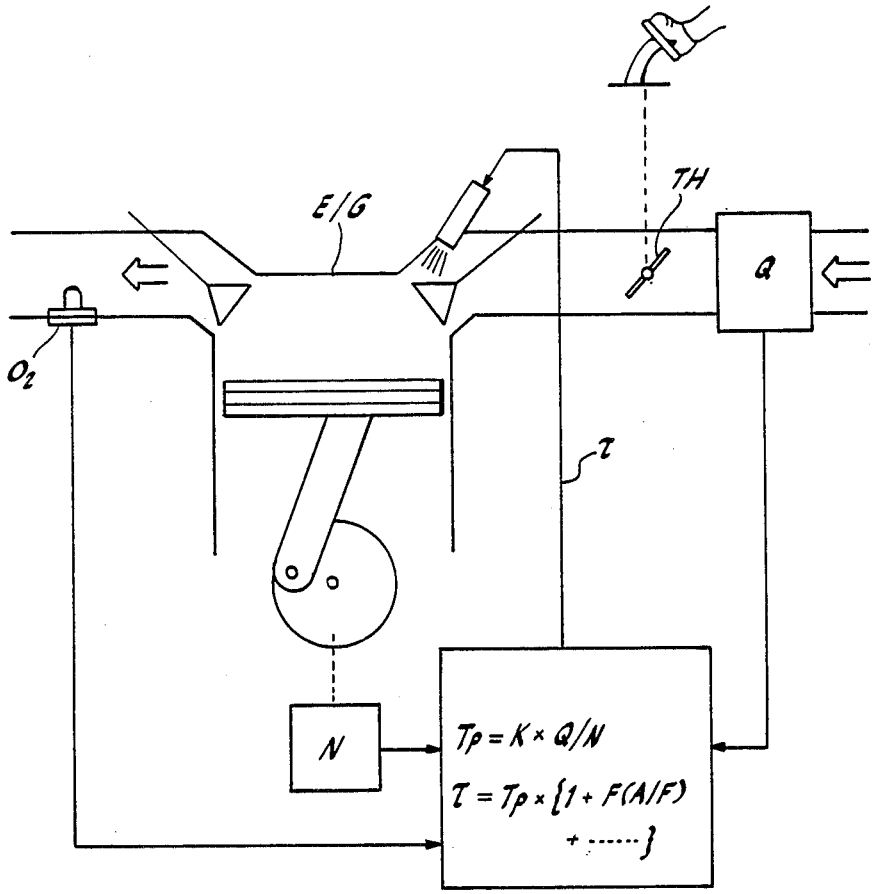
FIG. 2 is a schematic diagram showing briefly a conventional control apparatus for an internal combustion engine.
Figure 3:
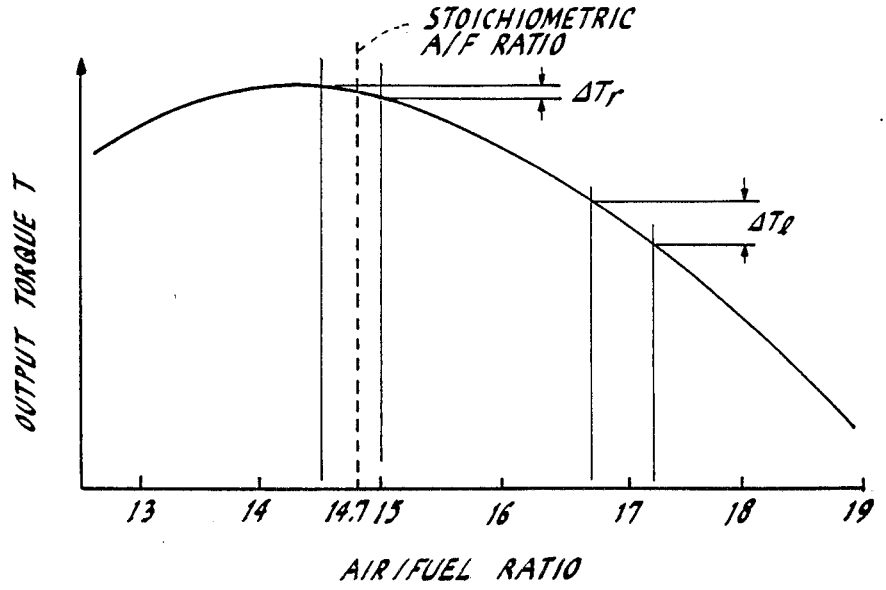
FIG. 3 is a graph showing the relatioship between air/fuel ratio and output torque.
Figure 4:
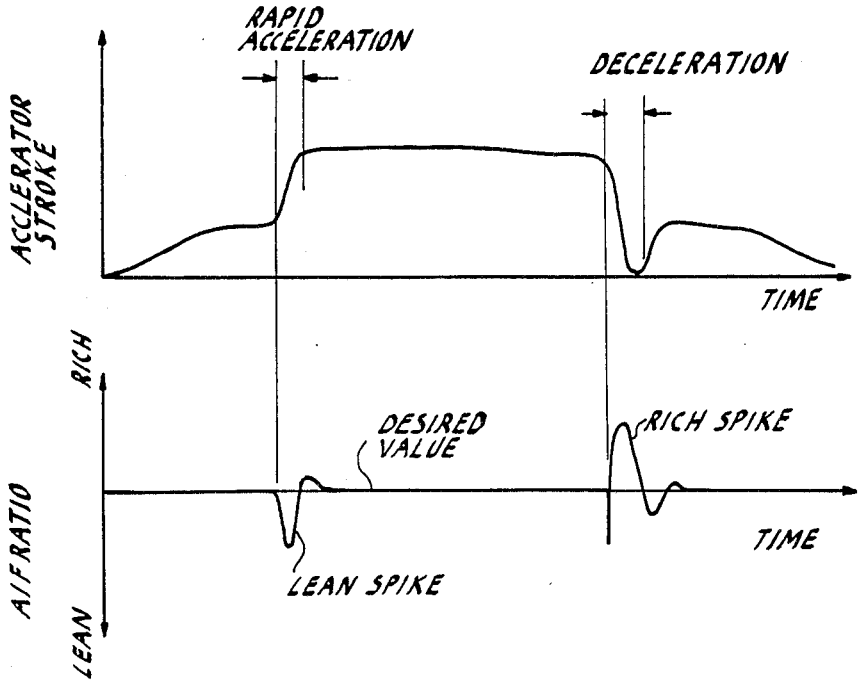
FIG. 4 is a graph for the description of lean spike and rich spike.

Referring now to FIG. 1, a schematic structural diagram of an embodiment of the present invention is shown. The reference M1 indicates an internal combustion engine to be controlled by the present invention, and the apparatus for controlling the operating state of the engine 1 comprises a demand amount detecting means M2, an operating condition varying means M3, an operating state detecting means M4, a target value setting means M5, and a control means M6.

Any gasoline engine may be used as the internal combustion engine M1 irrespective of the number of cylinders and the number of cycles.

The demand amount detecting means M2 is a structure which detects an amount of driver's demand to the output of the internal combustion engine M1, such as the stroke of the accelerator of the internal combustion engine mounted on a motor vehicle. This can also include, other than an accelerator, a structure which detects the demand of increase or decrease of the output of the internal combustion engine M1 in accordance with the variation in load of the internal combustion engine M1. For instance, an on-off signal from a compressor of a vehicle mounted air-conditioner, an idle up signal produced during idling and so on may correspond to this.

The operating condition varying means M3 is a means such as a set of actuators which vary the condition of operation of the internal combustion engine M1 including at least fuel supply amount and throttle valve opening degree, and may be an electromagnetic fuel injection valve which opens in response to a signal from the control means M5 and is capable of changing the amount of fuel injected by changing the valve-opening duration, or an actuator or the like which changes the opening degree of the throttle valve by way of a motor or the like. As the operating condition varying means M3 may be additionally used, depending on the type of the internal combustion signal M1, EGR amount control means including an electromagnetic valve or the like for changing the amount of recirculated exhaust gasses (EGR amount) or one which changes ignition timing of the internal combustion engine M1.

The operating state detecting means M4 is a set of sensors which detect variables of the operating state of the internal combustion engine including at least its output torque, rotational speed, intake air quantity, and may be a torque sensor or sensor which detects output torque, such as a cylinder internal pressure sensor for detecting combustion pressure, a sensor for detecting intake air quantity such as an airflow meter or an intake pipe pressure sensor, a rotational speed sensor which outputs a pulse signal having a frequency proportional to the rotational speed of the internal combustion engine M1 using the rotation of a rotor of a distributor. In addition, as the operating state detecting means M4 may be used, depending on the type of the internal combustion engine M1, an $O_2$ sensor which detects the concentration of oxygen within exhaust gasses, a knock sensor which detects knocking of internal combustion engine M1, a coolant temperature sensor which detects the temperature of coolant of the internal combustion engine M1, and an intake air temperature sensor.

The target value setting means M5 sets a target value of the operating state including at least output torque and intake air quantity of the internal combustion engine M1 on the basis of the amount of demand to the internal combustion engine M1, and is arranged to compute a target output torque and intake air quantity corresponding to the manipulated stroke of the accelerator and the state of the transmission. Especially, it operates in the present invention to compute the target intake air quantity as an intake air quantity which makes the amount of fuel supplied to the internal combustion engine M1 minimum. Here, the target intake air quantity which provides a minimum amount of fuel supplied to the internal combustion engine M1 which can be obtained as follows.

Figure 5:
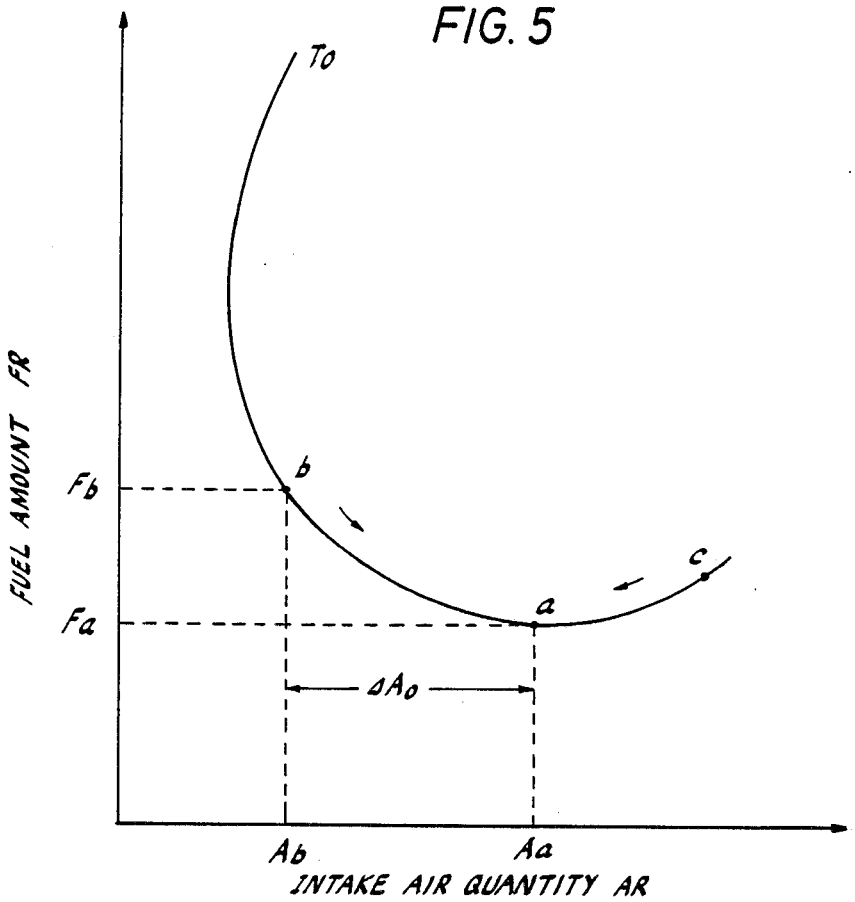
FIG. 5 is a constant-torque diagram showing the relationship between fuel amount FR and intake air quantity AR.

FIG. 5 is a torque diagram showing the relationship between intake air quantity AR and fuel supply amount FR when output torque T of the internal combustion engine M1 is made constant. Assuming that the internal combustion engine is operated when an intake air quantity is Ab, fuel supply amount is at point "b" of Fb, and output torque equals To, it will be understood that the fuel supply amount Fa becomes minimum at a point (Aa, Fa) where the intake air quantity has been incremented by ΔAo from that at point "b". The target value setting means M5 is constructed so that the fuel supply amount FR is made minimum with respect to the target value AR of the intake air quantity, and may be realized generally by a control performed by a microcomputer or the like as a part of a control means M6 which will be described hereinlater.

The control means M6 is realized by an electronic circuit constructed using a microprocessor together with a ROM, a RAM, peripheral units and input/output circuits, and is arranged to control the operating condition varying means M2 using feedback amount determined by optimal feedback gain determined by dynamic models of the system relating to the operation of the internal combustion engine M1 so that the operating state approaches the target. Namely, the control means M6 is constructed as an integral-added optimal regulator which determines an optimal amount of feedback from the variables of the operating state of the internal combustion engine M1 and the target value set by the target value setting means M5.

A method of constituting such a integral-added optimal regulator is described in detail in documents, such as "Linear System Control Theory" written by Katsuhisa FURUTA published by Shokodo Japan in 1976. An outlook for the method of actual forming of such regulator will be given hereinbelow. In the following description, the references F, X, A, B, C, y, u, L, G, Q, R, T, P indicate vectors (matrix), a superscript $^T$ such as $A^T$ indicating a transposed matrix, a superscript $^{-1}$ such as $A^{-1}$ indicating an inverse matrix, a symbol $\hat{}$ such as $\hat{X}$ indicating an estimate, a symbol $^-$ such as $\bar{C}$ indicating an amount handled by another system, i.e. a state observer (which will be simply referred to as observer hereinafter) which amount is generated by way of a transform or the like from the system which is a controlled object, and a symbol such as y indicating a target value respectively.

It is known in modern control theory that in a control of a controlled object, i.e. the control of the internal combustion engine M1 in this case, the dynamic behavior of the controlled object is described in discrete-time system as:

$$X(k)=A\cdot X(k-1)+B\cdot u(k-1) \quad (1)$$

$$y(k)=C\cdot X(k) \quad (2)$$

The above Eq. (1) is called a state equation, and Eq. (2) is called an output equation, and a term X(k) indicates state variables which represent the internal state of the internal combustion engine M1, a term u(k) indicates vectors comprising variables indicative of condition of operation of the internal combustion engine M1, and a term y(k) indicates vectors comprising variables representing the operating state of the internal combustion engine M1. The Eqs. (1) and (2) are both described in a discrete-time system, and a subscript "k" indicates that the value is of the present time, while a subscript "k−1" indicates that the value is of an instant which is one sampling cycle before the present time.

The state variables X(k) indicating the internal state of the internal combustion engine M1 represent information relating to the history of the system which is necessary and sufficient for predicting the influence in the future in the control system. Therefore, the dynamic model of the system relating to the operation of the internal combustion engine M1 will be clear, and if we can determine vectors A, B and C of Eqs. (1) and (2), then it is possible to optimally control the operation of the internal combustion engine using the state variables X(k). In a servo system, while the system has to be expanded, this will be described hereinlater.

It is difficult to accurately theoretically obtain dynamic models of a complex objective such as an internal combustion engine M1, and therefore, it is necessary to obtain the same through experiments. This is a method of constructing a model, which method is the so called system identification, and in the case that internal combustion engine M1 is operated under a given state, the model is constructed according to state equation (1) and output equation (2) with which linear approximation is satisfied around the given state. Therefore, even in the case that the dynamic model related to the operation of the internal combustion engine M1 is nonlinear, a linear approximation can be performed by dividing into a plurality of normal operating states, and therefore it is possible to determine each dynamic model.

If the controlled object is of a sort that of which physical model can be relatively easily constructed, then the model (i.e. vectors A, B, and C) of a dynamic system can be determined through system identification which can be made through a method such as frequency response method or spectrum analysis. However, in the case of a controlled object of a multivariable system, such as the internal combustion engine M1, it is difficult to make a physical model which is accurately approximated. In such a case, the dynamic model is constructed using a least squares method, instrumental variable method or on-line identification.

Once a dynamic model is determined, an amount of feedback is determined from the state variables X(x), the variables y(k) of the operating condition and its target value y*(k), so that controlled variables u(k) of the condition of operation are theoretically and optimally determined. In an internal combustion engine M1 or the like, as variables directly influencing on the operation of the internal combustion engine M1, such as air amount actually sucked and the dynamic behaviour of combustion, or fuel amount within the mixture related to combustion, output torque of the internal combustion engine, may be treated as the state variables X(k). However, most of such variables are difficult to be directly measured.

Therefore, means called state observer (observer) is formed within the control means M6 in order to allow estimation of the state variables X(k) of the internal combustion engine M1 using values of the variables of the condition of operation of the internal combustion engine M1 and the variables of the operating state. This is the observer according to modern control theory, and various types of observer and their designing methods are known. These are described in detail, for instance, in "Mechanical System Control" written by Katsuhisa Furuta, published by Ohm Co. Ltd. in 1984, and the observer may be designed as a minimal order observer or a finite time settling observer in correspondence with the fashion of an applied controlled object, i.e. the internal combustion engine M1 and apparatus for controlling the operating state thereof.

The control means M6 controls the condition of operation varying means M3, in a system expanded using measured state variables or state variables X(k) estimated by the above-mentioned observer and an accumulated value obtained by accumulating the differences between a target value of the operating state variables of the internal combustion engine M1 estimated by the target value setting means M5 and variables of actual operating state, by determining an optimal feedback amount from both thereof and also from a predetermined optimal feedback gain. The accumulated value is a value which is necessary since the target value of the operating state varies depending on the amount of demand to the internal combustion engine M1. In a control of a servo system, it is required generally to perform a control for cancelling steady-state error between the target value and an actual controlled variable, and this corresponds to the necessity of inclusion of $1/S^l$ (integration of $l^{th}$ order) in a transfer function. In the case that a state equation is made with the transfer function of the system being determined through system identification as described in the above, it is preferable to include such integrated amount in view of stability against noise. In the present invention, $l=1$, namely, integration of first order may be considered. Therefore, when the accumulated value is introduced into the above-mentioned state variable X(k) to expand the system so as to determine the feedback amount from these values and a predetermined optimal feedback gain F, the controlled variables of the controlled object, i.e. the variables of the condition of operation of the internal combustion engine M1, are determined as an integral-added optimal regulator.

Nextly, it will be described in connection with optimal feedback gain. In an optimal regulator to which an integral element is added as described in the above, the way of finding a control input (the variables of the condition of operation of the internal combustion engine M1 in this case) which minimizes a performance index J is made clear, while it is also known that the optimal feedback gain can be obtained from a solution of Riccati equation, A, B, C matrixes of the state equation (1) and the output equation (2), and the weighted parameter used in performance index (see the above-mentioned book). In the above, the weighted parameter is initially arbitrarily given so as to change the weighting in the regulation, by the performance index J, of the behavior of the variables of the condition of operation of the internal combustion engine M1. It is possible to determine an optimal value through repetition of simulation by changing the weighted parameter by a given amount from the behavior of the operating state variables which are obtained as the result of siumulation performed by a large computer with an arbitrary weighted parameter being given. As a result, an optimal feedback gain F is also determined.

Therefore, the control means M4 in the operating state control apparatus for an internal combustion engine according to the present invention is formed as an integral-added optimal regulator using a dynamic model of the internal combustion engine M1 which dynamic model is determined in advance through system identification, and the parameter of the observer therein and an optimal feedback gain F and so on are determined in advance through simulation using the internal combustion engine M1.

While it has been described that the state variable X(k) is an amount indicating the internal state of the internal combustion engine M1, this is not required to be a variable corresponding to actual physical amount, and therefore, this may be designed as a vector of an appropriate order which is suitable for indicating the state of the internal combustion engine M1.

The apparatus for controlling operating state of an internal combustion engine according to the present invention having the above-described structure operates such that target output torque and target intake air quantity are computed using the amount of demand to the internal combustion engine M1, such as variables including the manipulation amount of an accelerator by the target setting means M5, and then the control means M6 formed as an integral-added optimal regulator controls the operating condition varying means M3 with an optimal feedback amount being obtained with which variables of the internal combustion engine M1 equal the above-mentioned target values. Furthermore, since the target value setting means M5 operates to compute target intake air quantity so that the fuel consumption amount becomes minimum under a condition that the output torque of the internal combustion engine is constant, the apparatus for controlling the operating state of an internal combustion engine according to the present invention optimally controls the internal combustion engine M1 to obtain an operation state where fuel consumption amount is minimum with a target output torque.

Figure 9:
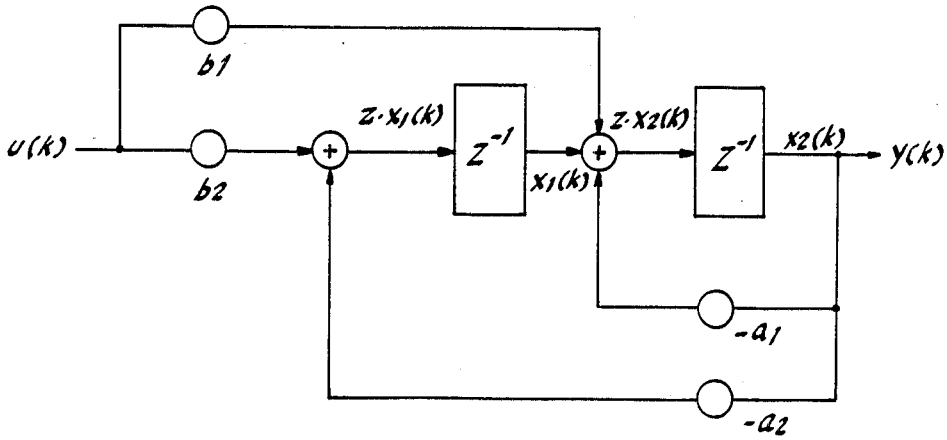
FIG. 9 is a signal flow diagram for obtaining transfer function.
Figure 6:
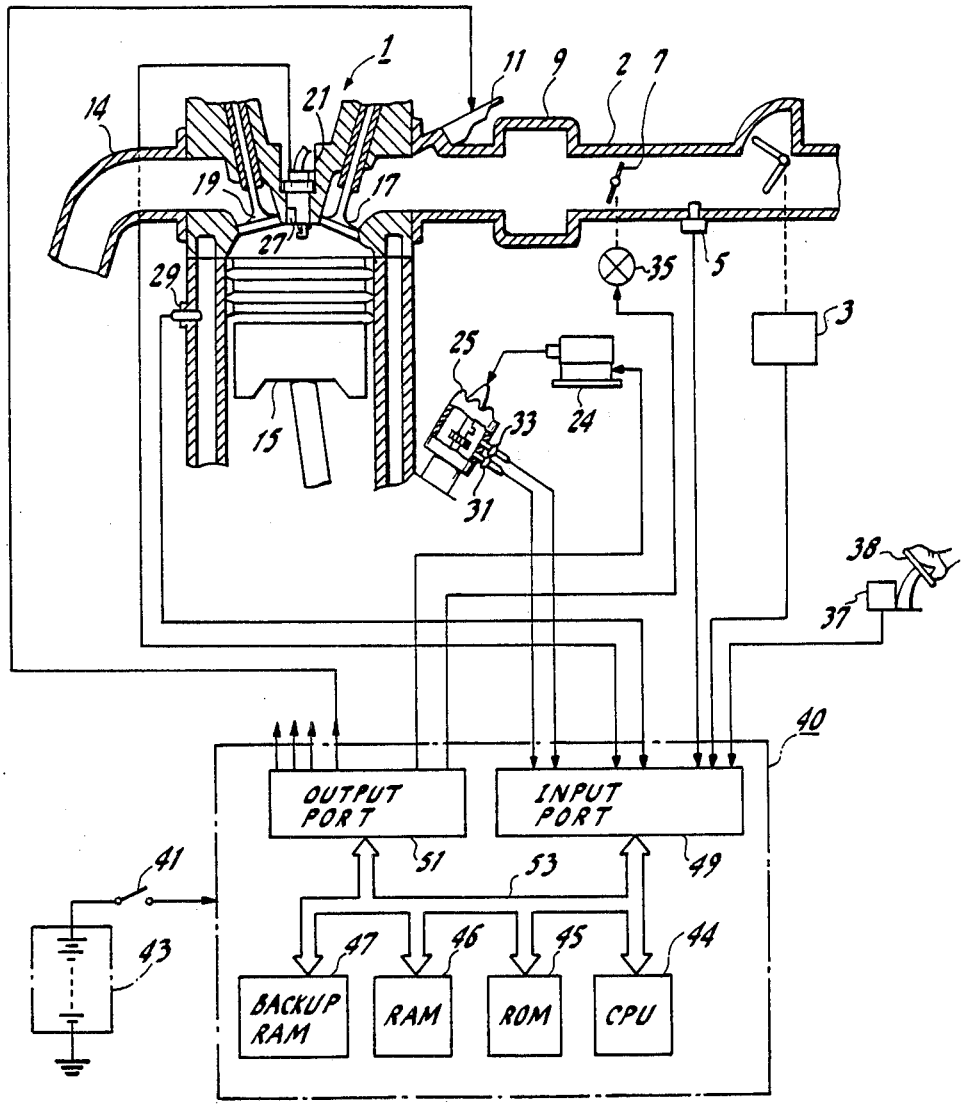
FIG. 6 is a schematic structural diagram showing the structure of an internal combustion engine and its peripheral units as an embodiment of the present invention.
Figure 7:
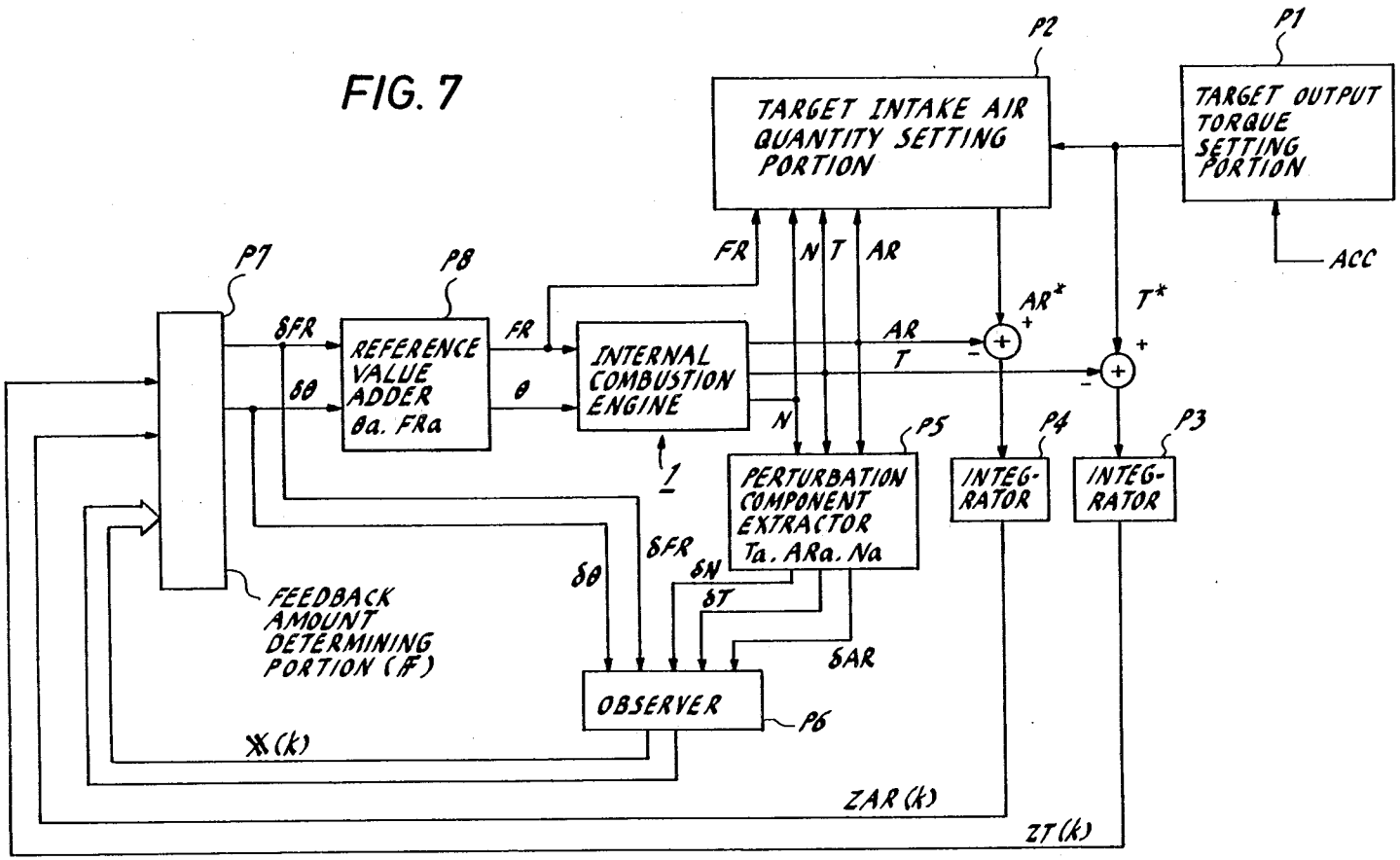
FIG. 7 is a control system diagram of the embodiment.
Figure 8:
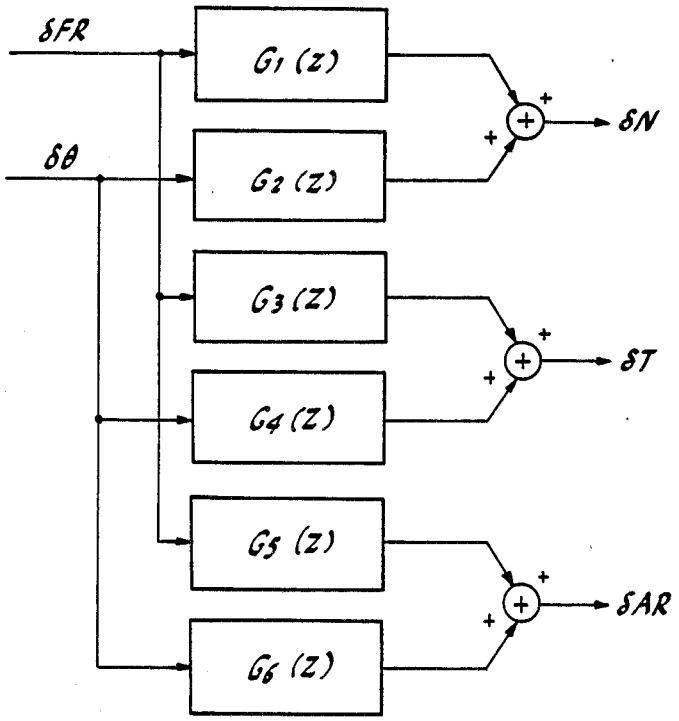
FIG. 8 is a block diagram used for identifying a model of a system of the embodiment.
Figure 10:
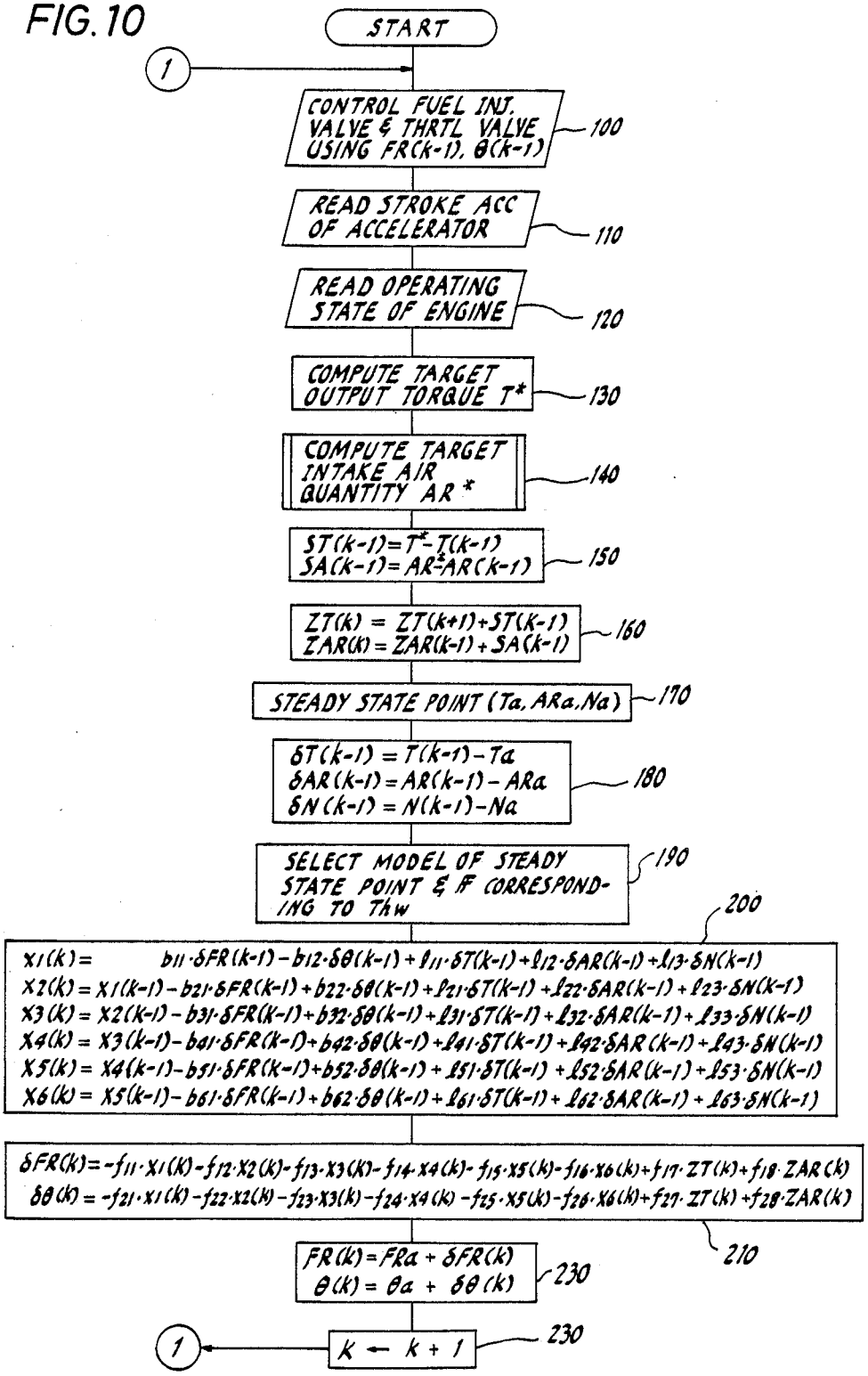
FIG. 10 is a flowchart showing the control as an integral-added optimal regulator in the embodiment.

Embodiments of the present invention will be described with reference to drawings in detail. FIG. 6 is a schematic structural diagram showing an internal combustion engine according to an embodiment of the present invention, and its peripheral units; FIG. 7 is a control system diagram showing a control model of a system where operating state of the internal combustion engine is controlled; FIG. 8 is a block diagram for the description of system identification; FIG. 9 is a flowchart showing one example of a control executed by an electronic control circuit; FIG. 10 is a flowchart showing one example of a control for obtaining intake air quantity with which fuel compution is made minimum; and the description will be given in this order.

Although FIG. 6 shows a four-cylinder four cycle internal combustion engine 1 in connection with only one cylinder, there are provided, in an order from upstream portion, an unshown air cleaner, an airflow meter for measuring intake air quanitity AR, an intake air temperature sensor 5 for detecting an intake air temperature Tha, a throttle valve 7 for controlling intake air quantity, a surge tank 9, and electromagnetic fuel injection valves 11. Exhaust gasses from the internal combustion engine 1 are exhausted outside from an exhaust pipe 14 via unshown exhaust gas cleaner, muffler and so on. While a combustion chamber (cylinder) is formed of a piston 15, an intake valve 17, an exhaust valve 19, a spark plug 21 and so on, description of the operation thereof is omitted since it is well known. Within the spark plug 21 arranged to form spark in receipt of a high voltage fed from an igniter 34 via a distributor 25, is built a pressure sensor 27 of the semiconductor type so as to detect combustion pressure, namely output of the internal combustion engine. This will be treated as output torque T hereinafter.

In addition to these, the internal combustion engine 1 comprises a coolant temperture sensor 29 for detecting the temperature Thw of the coolant, a rotational speed sensor 32 installed in the distributor 25 for outputting a pulse signal having a frequency corresponding to the rotational speed N of the internal combustion engine 1, an a cylinder-determination sensor 33 for outputting a one-shot pulse per one revolution (720° crank angle) of the internal combustion engine 1. The opening degree of the throttle valve 7 is controlled by an actuator 35 whose prime mover is a d.c. motor. In FIG. 6, the reference 37 is an accelerator opening degree sensor for detecting the stroke Acc of the accelerator 38.

In the internal combustion engine 1 and its peripheral devices having the above-mentioned structure, the fuel injection amount FR, throttle valve opening degree $\theta$ and so on are controlled by an electronic control circuit 20. The electronic control circuit 40 is supplied with electrical power from a battery 43 via a key switch 41, and comprises a well known microprocesor (MPU) 44, ROM 45, RAM 46, backup RAM 47, input port 49, output port 50, and so on, where the above-mentioned respective elements and ports are interconnected via a bus 53.

The input port 49 of the electronic control circuit 40 receives signals indicative of the amount of demand of the internal combustion engine 1 and its operating state from respective sensors. More specifically, it comprises an unshown analog input unit for receiving accelerator openig degree Acc from the accelerator opening degree sensor 37 as the amount of demand, intake air quantity AR from the airflow meter 3 as the operating state, intake air temperature Tha from the intake air temperature sensor 6, output torque T from the pressure sensor 27, coolant temperature Thw from the coolant temperature sensor 29 to A/C convert them and then to supply the same to the MPU 44 as data, and an unshown pulse input unit for receiving rotational speed N of the internal combustion engine 1 from the rotational speed sensor 31 and cylinder-determination signal from the cylinder-determination sensor 33.

On the other hand, the output port 51 outputs control signals for controlling opening degree $\theta$ of the throttle valve 7 via an actuator 35, fuel injection amount FR by opening and closing the fuel injection valves 11, and ignition timing via an igniter 24. The control by the MPU 44 of the electronic control circuit 40 will be described hereinlater in detail with reference to flowcharts of FIGS. 10 and 11.

Now, the control system within the electronic control circuit 40 will be described with reference to a control diagram of FIG. 7, and especially, it will be described the way of vectors A, B, C of the state equation (1) and output equation (2) by way of system identification and the way of obtaining observer and feedback gain F based thereon taking actual examples. FIG. 7 is a diagram showing a control system, and does not show hardware structure. Furthermore, the control system shown in FIG. 7 is realized by executing a series of porgrams shown in the flowchart of FIG. 10 in practice, and is realized as a discrete-time system.

As shown in FIG. 7, a target output torque T* is set by a torque setting unit P1 using accelerator opening degree Acc as base. On the other hand, a target intake air quantity AR* is deterimed as a value which causes minimum fuel consumption amount by a target intake air quantity setting unit P2 through a method which will be described in detail with reference to FIG. 11 hereinlater, using the target output torque T*, actually detected intake air quantity AR, output torque T, rotational speed N, and fuel injetion amount FR injected into the internal combustion engine 1. Integrators P3 and P4 are used for obtaining an accumulated value ZT(k) by accumulating the deviations ST of target output torque T* from actual output torque T, and another accumulated value ZAR(k) by accumulating deviations SAR of target intake air quantity AR from actual intake air quantity AR.

The reference P5 indicates a perturbation component extracting portion which extracts a perturbation component from various values (Ta, ARa, Na) under the state where steady operating state in connection with output torque T, intake air quantity AR and rotational speed N. This is based on the fact that the dynamic model of the system is constructed by regarding the operating state of the internal combustion engine 1 as the continuance of regions where linear approximation is satisfied around a plurality of operating points in order to perform linear approximation for a nonlinear model. Therefore, variables of the internal combustion engine 1 are handled as a perturbation component δT (=T−Ta), δAR (=AR−ARa), δN (=N−Na) relative to a predetermined nearest operating point. The condition of operation of the internal combustion engine 1, i.e. throttle opening degree θ, a controlled variable relating to the fuel injection amount FR, which are obtained by the above-mentioned integrators P3, P4, the observer P6 and the feedback amount determining unit P7, are also handled as perturbation components δθ and δFR.

The observer P6 obtains state estimated variables $\hat{X}$ (k) by estimating state variables x(k) which respresent the internal state of the internal combustion engine 1 using the perturbation component δθ and δFR of the condition of operation and the perturbation components δT, δAR, and N of the above-mentioned operating state, and the state estimated variables X (k) and the above-mentioned accumulated value ZT(k) and AR(k) are multiplied by the optimal feedback gain F in the feedback amount determining portion P7 so as to obtain controlled variables (δθ, δFR). Since the set of the controlled variables (δθ, δFR) are perturbation components relative to operating condition corresponding to steady operating state selected by the perturbation component extracting portion P5, the variables θ and FR of the operating condition of the internal combustion engine 1 are determined by adding reference setting values θa and FRa corresponding to the steady operating condition to the perturbation components by a reference setting value adding portion P8.

While the structure of the control system has briefly been described, the reason that these operating state (T, AR, N) and operating condition (θ, FR) are used in this embodiment, is that these variables are basic values relating to the control of the internal combustion engine 1. Therefore, in this embodiment, the internal combustion engine 1 is grasped as a multivariable system of two inputs and three outputs. In addition to these, ignition timing and exhaust gas recirculation amount, for example, may be used as the amounts relating to the output of the internal combustion engine 1, and these may be taken into consideration when constructing a model of the control system. The above-mentioned model having two inputs and three outputs is used for constructing the dynamic model of the internal combustion engine 1, and in addition to these coolant temperature Thw and intake air temperature Tha of the internal combustion engine 1 are also used as factors which change the dynamic behaviour of the system. The coolant temperature Thw and so on do not change the structure of the control system but changes the state of dynamic behaviour thereof. Therefore, when the dynamic model is constructed in connection with the control system of the internal combustion engine 1, the vectors A, B, C of the state equation (1) and the output equation (2) are determined in accordance with the coolant temperature Thw and so on of the internal combustion engine 1.

Hereinabove, the hardware structure of the internal combustion engine 1 and the structure of the control system have been described taking a system of two inputs and three outputs as an example which controls the output of the internal combustion engine 1. Now it will be described about the construction of a dynamic model through actual system identification, the designing of the observer P6, and how to give provide the optimal feedback gain F.

First of all, a dynamic model of the internal combustion engine 1 is constructed. FIG. 8 is a diagram showing a system of the internal combustion engine 1 under steady state operation as a system having two inputs and three outputs by way of transfer functions G1(z) through G6(z). The reference z indicates z transformation of sampled values of the input/output signals, and it is assumed that G1(z) through G6(z) have appropriate order. Therefore, the entire transfer function matrix G(z) is given by:

$$G(z) = \begin{pmatrix} G1(z) & G2(a) \\ G3(z) & G4(z) \\ G5(z) & G6(z) \end{pmatrix}$$

When there exists an interference in the input/output variables, where the system is of two inputs and three outputs as in the internal combustion engine 1 of this embodiment, it is extremely difficult to determine a physical model. In such a case, it is possible to obtain transfer function through simulation so called system identification.

The method of system identification is described in detail in "System Identification" written by Setsuo SAGARA published by Measurement and Automatic Control Society of Japan in 1981, and identification is performed here through the least square method.

The internal combustion engine 1 is put in predetermined steady operating state, and the variation δθ of the throttle opening degree is made zero to add an appropriate test signal to the variation δFR of the supplied fuel amount and data of input δFR at this time and variation δN of the rotational speed as an output is sampled N times. This is expressed as input data series of {u(i)}={δFRi} and as output data series of {y(i)}={δNi} wherein i=1, 2, 3 . . . N. Here, the system can be regarded as having one input and one output, and thus the transfer function G1(z) is given by:

$$G1(z)=B(z^{-1})/A(z^{-1}) \tag{3}$$

Therefore, $$G1(z)=(b0+b1\cdot z^{-1}+\ldots +bn\cdot z^{-n})/(1+a1\cdot z^{-1}+a2\cdot z^{-2}+\ldots +an\cdot z^{-n}) \tag{4}$$

In the above, $z^{-1}$ is a unit shift operator indicating $z^{-1}\cdot x(k)=x(k-1)$.

When we determine parameters a1 to an and b0 to bn of Eq. (4) from the input and output data series {u(i)} and {y(i)}, transfer function G1(z) can be obtained. These parameters are determined in system identification using the least square method so that the following assumes a minimal value:

$$Jo = \sum_{k=n}^{N} [\{y(k) + a1\cdot y(k+1) + \ldots + an\cdot y(k-n)\} - \{b0\cdot u(k) + b1\cdot u(k+1) + \ldots + bn\cdot u(k-n)\}]^2 \tag{5}$$

In this embodiment, respective parameters have been obtained assuming that n=2. In this case, a signal flow diagram of the system is as shown in FIG. 9, and using [X1(k)] as state variables, state and output equations thereof can be expressed by Eqs. (6) and (7):

$$\begin{bmatrix} X1(k-1) \\ X2(k-1) \end{bmatrix} = z\begin{bmatrix} X1(k) \\ X2(k) \end{bmatrix} = \begin{bmatrix} 0 & -a2 \\ 1 & -a1 \end{bmatrix}\begin{bmatrix} X1(k) \\ X2(k) \end{bmatrix} + \begin{bmatrix} b2 \\ b1 \end{bmatrix} u(k) \tag{6}$$

$$y(k) = [0\ 1]\begin{bmatrix} X1(k) \\ X2(k) \end{bmatrix} \tag{7}$$

Therefore, using system parameters A1', B1', C1' for the parameters A, B, C in the case that the system is regarded as of one input and one output, we obtain:

$$A1' = \begin{bmatrix} 0 & -a2 \\ 1 & -a1 \end{bmatrix} \tag{8}$$

$$B1' = [b2\ b1]^T$$

$$C1' = [0\ 1]$$

In this embodiment, the following is obtained as the parameter in connection with G1(z):

$$[a1\ a2] = [-1.91\ 0.923]$$

$$[b0\ b1\ b2] = [0\ 4.86 \times 10^{-3}\ 4.73 \times 10^{-3}]$$

Through similar method transfer functions G2(z) through G6(z) as well as system parameters A2' through A6',B2' through B6', and C2' through C6' can be obtained. Therefore, using these system parameters, the system parameter of the original multivariable system of two inputs and three outputs, namely, vectors A, B, C of state equation (1) and output equation (2) can be determined.

In this way, the dynamic model of the present embodiment is obtained through system identification, and this dynamic model can be determined in the form that linear approximation is satisfied around a state where the internal combustion engine 1 operated under a given state. Therefore, the transfer function G1(z) through G6(z) are respectively obtained through the above method in connection with a plurality of steady operating states, and respective state equations (1) and output equations (2), i.e. vectors A, B, C, are obtained where the relationship between input and output thereof is satisfied between perturbation components $\tau$.

Now the way of designing the observer P6 will be described. While as the way of designing is known Gopinath' method, which is described in detail in "Basic System Theory" written by katsuhisa FURUTA and Akira SANO published from Corona Co. Ltd. in 1978, the observer is designed as a minimal order observer in this embodiment.

The observer P6 is used for estimating the internal state variable X(k) of the internal combustion engine 1 from the perturbation component ($\delta\theta$, $\epsilon$FR) of the variables of the condition of operation and from perturbation components ($\delta$T, $\delta$AR, $\delta$N) of the variables of the operating state of the internal combustion engine 1, and the reason why the state estimated variables X(k) obtained by the observer P6 can be handled as actual state variable X(k) in the control of the internal combustion engine 1 will be made clear hereinbelow. Let us assume that the output X(k) from the observer P6 is constructed as the following Eq. (9):

$$\hat{X}(k) = (A - L\cdot C)\cdot\hat{X}(k-1) + B\cdot u(k-1) + L\cdot y(k-1) \tag{9}$$

In Eq. (9), L is a matrix arbrarily given. Modifying Eqs. (1), (2) and (9), we obtain:

$$[X(k) - \hat{x}(k)] = (A - L\cdot C)[X(k-1) - \hat{X}(k-1)] \tag{10}$$

Therefore, if the matrix L is selected so that an eigenvalue of the matrix (A−L·C) is located within a unit circle $\hat{X}(k) \rightarrow X(k)$ with $k \rightarrow \infty$, and thus it is possible to accurately estimate the internal state variable X (k) of the controlled object using series u(*), y(*), from the past, of the input control vector u(k) and the output vector y(k).

The vectors A, B, C of the state equation (1) and the output equation (2) both determined through system identification through the least squares method, can be similarly transformed into the following observable canonical structure considering new state variable $\overline{X}(k) = T^{-1}\cdot X(k)$ using nonsingular matrix T because the system is observable.

$$X(k) = \overline{A0}\cdot\overline{X}(k-1) + \overline{B0}\cdot u(k-1) \tag{11}$$

$$y(k) = \overline{C0}\cdot\overline{X}(k) \tag{12}$$

In the above, $\overline{A0} = T^{-1}\cdot A\cdot T$, $\overline{B0} = T^{-1}\cdot B$ $\overline{C0} = C\cdot T$, and we obtain the following equations by selecting appropriate nonsigular T.

$$\overline{A0} = \begin{bmatrix} 0\ 0 \ldots & -\alpha 1 \\ 1\ 0 \ldots & -\alpha 2 \\ 0\ 1 \ldots & \cdot \\ \ldots & \cdot \\ \ldots & \cdot \\ \ldots & \cdot \\ 0\ 0 \ldots 1 & -\alpha n \end{bmatrix} \tag{13}$$

$$\overline{B0} = [\beta 1\ \beta 2 \ldots \beta n]^T \tag{14}$$

$$\overline{C0} = [0\ 0 \ldots 1] \tag{15}$$

Then, let L matrix be replaced as $L = [-\alpha 1\ -\alpha 2 \ldots -\alpha n[^T$, and we can now design a finite time settling observer as follows using equations (13), (14) and (15):

$$\overline{A0} - L\cdot\overline{C0} = \begin{bmatrix} 0\ 0 \ldots\ldots & 0 \\ 1\ 0 \ldots\ldots & 0 \\ 0\ 1 \ldots\ldots & 0 \\ \ldots & \cdot \\ \ldots & \cdot \\ \ldots & \cdot \\ 0\ 0 \ldots 1 & 0 \end{bmatrix} \tag{16}$$

In the above, $\overline{A0}$, $\overline{B0}$ and $\overline{C0}$ are obtained through similarity transformation using A, B, and C, and it is also ensured that the control by the state equation is correct from this operation.

While the observer P6 has been designed using the vectors A, B and C of the state equation obtained through system identification, the output of the observer is now expressed in terms of $\hat{X}(k)$ hereinafter.

Now the way of obtaining the optimal feedback gain F will be described. Since the way of obtaining optimal feedback gain F is described in detail in the above-mentioned "Linear System Control Theory", only the results are shown here with the detail thereof being omitted.

Using $$u(k)=u(k)-u(k-1) \tag{17}$$

$$y(k)=y(k)-y(k-1) \tag{18}$$

in connection with the operating condition variables u(k) and operating state variables y(k), obtaining an optimal control input, i.e. operating condition u*(k), which makes the following performance index J minimal, results in solving a control problem as an integral-added optimal regulator related to the control system of the internal combustion engine 1.

$$J = \sum_{k=0}^{\infty} [y^T(k) \cdot Q \cdot y(k) + u^T(k) \cdot R \cdot u(k)] \tag{19}$$

In the above, Q and R indicate weighted parameter matrixes, and k indicates the number of sampling times which is zero at the time of beginning of control, while the right side of Eq. (19) is an expression of so called quadratic form using diagonal matrixes of Q and R.

Here, the optimal feedback gain F is given as follows:

$$F=-(R+\bar{B}^T \cdot P \cdot)^{-1} \cdot \bar{B}^T \cdot P \cdot \bar{A} \tag{20}$$

In Eq. (20), A and B are gven by:

$$\bar{A} = \begin{bmatrix} 1 & -\overline{C0} \cdot \overline{A0} \\ 0 & \overline{A0} \end{bmatrix} \tag{21}$$

$$\bar{B} = \begin{bmatrix} -\overline{C0} \cdot \overline{B0} \\ \overline{B0} \end{bmatrix} \tag{21}$$

Furthermore, P is a solution of the following Riccati equation:

$$P = \bar{A}^T \cdot P \cdot \bar{A} - \bar{A}^T \cdot P \cdot \bar{B} \cdot (\bar{B}^T \cdot P \cdot \bar{B} + \bar{R})^{-1} \cdot \bar{B}^T \cdot P \cdot \bar{A} + \begin{bmatrix} Q & 0 \\ 0 & 0 \end{bmatrix} \tag{23}$$

In the above, the performance index J in Eq. (19) has a meaning that it is intended to reduce the deviation of the operating state variables y(k), i.e. variables y(k) including at least the intake air quantity δAR, and rotational speed δN, from the target value y (k), with the variation of operating condition variables u (k)=[δθδFR] as the control inputs to the internal combustion engine 1 being regulated. The weighting of regulation of the variables u(k) of operating conditions can be altered by changing the values of the weighted parameter matrixes Q and R. Therefore, the state variables X(k) can be obtained as state estimated variables X(k) using Eq. (9) if we obtain the optimal feedback gain F using Eq. (20) by obtaining P solving Eq. (23) with arbitrarily weighted parameter matrixes Q, R being selected using the dynamic model of the internal combustion engine 1, i.e. matrixes A, B, C (which correspond to the above-mentioned $\bar{A}$, $\bar{B}$, $\bar{C}$) which is obtained in advance. Therefore, the variables u (k) of the control input operating condition for the internal combustion engine 1 can be obtained as follows:

$$u(k)=F \cdot [X1(k)X2(k)n(k)\ ZT(k)\ ZAR(k)]^T \tag{24}$$

Bt repeating simulation with the weighted parameter matrixes Q and R being altered until an optimal control characteristic is obtained, the optimal feedback gain F is obtained.

While it has been described about the construction of the dynamic models of the control system of the internal combustion engine 1 made through system identification using least square method, the designing of finite time settling observer and the computation of the optimal feedback gain F, these are obtained in advance so that actual control is performed within the electronic control unit 40 using only the results thereof.

Now, an actual control performed by the electronic control circuit 40 will be described with reference to a flowchart of FIG. 10. In the following description, an amount handled in a present processing is expressed by a subscript (k) and an amount handled in the latest cycle by another subscript (k−1).

After the internal combustion engine 1 starts operating, the MPU 44 executes repeatedly step 100 and the following steps. At first in the step 100, the fuel injection valves 11 are opened and the throttle valve 7 is controlled via the actuator 35 using the fuel injection amount FR(k−1) and throttle valve opening degree θ(k−1) both obtained in previous series of processings. In a folloiwng step 110, the depressed stroke of the accelerator 38 is read by the accelerator sensor 37, and in a step 120 the operating state of the internal combustion engine 1, i.e. the output torque T(k−1), intake air quantity AR(k−1), and rotational speed N(k−1) and so on, is read from respective sensors.

In a following step 130, a target output torque T* of the internal combustion engine 1 is computed on the basis of the depressed stroke of the accelerator 38, and in a step 140 a target intake air quantity AR* of the internal combustion engine 1 is computed. This target intate air quantity AR* is determined so that the amount of fuel consumed by the internal combustion engine 1 is minimum, and the computation thereof is controlled as will be described hereinlater with reference to FIG. 11. These processings correspond to respective setting portions P1 and P2 of FIG. 7.

In a step 150, the deviation ST of an actually detected output torque T(k−1) from the target output torque T* and the deviation SA of actual intake air quantity AR(k−1) from the target intake air quantity AR* are obtained. In a subsequent step 160, respective deviations obtained in the step 150 are accumulated to obtain accumulated value ZT(k) using $ZT(k)=ZT(k-1)+ST(k-1)$ and another accumulated value ZAR(k) using $ZAR(k)=ZAR(k-1)+SA(k-1)$.

This processing corresponds to the integrators P3 and P4 of FIG. 7.

In a following step 170, a nearest state (which will be referred to as operating points Ta, ARa, NA) among steady-state operating states taken as satisfying linear approximation when the dynamic model of the internal combustion engine 1 is constructed, is obtained from the operating state read in step 120. In a step 180, the operating state of the internal combustion engine 1 is obtained as perturbation components (δT, δAR, δN) relative to the steady state points (Ta, ARa, Na). This processing corresponds to the perturbation component extracting portion P5 of FIG. 7.

In a subsequent step 190, temperature Thw of the coolant of the internal combustion engine 1 is read, and since the dynamic model of the internal combustion engine 1 changes in accordance with the coolant temperature Thw, parameters $\overline{A0}$, $\overline{B0}$, L and optimal feedback gain F prepared within the observer in advance for respective coolant temperatures Thw are selected.

In a step 200, new state estimated value X(k) is obtained through the following equation (25) using $\overline{A0}$, $\overline{B0}$, L selected in the step 190, the perturbation components (δT, δAR, δN) obtained in this tep 180, state estimated value $X(k-1)=[X1(k-1)\ \ X2(k-2)\ \ .\ .\ .\ X6(k-1)]^T$ obtained in the previous cycle, the perturbation component δFR(k−1), δθ(k−1) of the fuel injection amount FR(k−1) and the throttle valve opening degree θ (k−1) both obtained in the previous cycle. This processing corresponds to the observer P6 of FIG. 7, and the observer P6 is constructed as a finite time settling observer in this embodiment as described in the above. Namely, the following computation is performed:

$$\hat{X}(k)=\overline{A0}\cdot\hat{X}(k)+\overline{B0}\cdot[\delta FR\delta\theta]+L\cdot[\delta T(k-1)]\delta AR(k-1)\delta N(k-1) \quad (25)$$

In a following step 210, the state estimated value X(k) obtained in the step 200, the accumulated values ZT(k), ZAR(k) obtained in step 160, the feedback gain prepared in advance and selected in the step 190 which feedback gain is given by:

$$F=\begin{bmatrix} -f11 & -f12 & \ldots & -f16 & f17 & f18 \\ -f21 & -f22 & \ldots & -f26 & f27 & f28 \end{bmatrix}$$

are vector multiplied to obtain perturbation components δFR(k) and δθ(k) using $[\delta FR(k)\ \delta\theta(k)]=F\cdot[\hat{X}(k)\ ZT(k)\ ZAR(k)]^T$. This corresponds to the feedback amount determining portion P7 of FIG. 7.

In a step 220, the perturbation components δFR(k), δθ(k) of the controlled variables obtained in the step 210 are added to the respective controlled variables FRa, θa at the steady-state points, and controlled variables, i.e operating conditions FR(k), θ(k), actually outputted to the fuel injection valves 11 and the actuator 35 of the internal combustion engine 1 are obtained.

In a following step 230, the value "k" indicative of the number of times of samplings is incremented by 1, and the opertional flow returns to the step 100 to repeat the above-mentioned series of processings, i.e steps 100 through 230.

By continuously performing the above-mentioned control, the electronic control unit 40 performs control using an optimal feedback gain as an integral-added optimal regulator which controls the operating state of the internal combustion engine 1 to the target output torque T* and to target intake air quantity AR*.

Now it will be described about a routine for obtaining the target intake air quantity AR* of the step 140. In this routine, as shown in a flowchart of FIG. 11, the target intake air quantity AR*, which makes fuel consumption amount minimum while the same output torque T(k) is maintained, is computed through the following steps. In the following description, the target value of the previous cycle may be expressed in terms of AR* (k−1), and the target value newly computed in the present cycle may be expressed in terms of AR*(k).

This routine starts at a step 300, and it is determined wheather the target output torque T*(k), the actual output torque T(k), and the rotational speed N(k) determined in the processing of FIG. 10 are respectively equal to previous cycle values T*(k−1), T(k−1) and N(k−1). In the case that one or more of the three values are not equal to the previous values, the control system has not reached equilibrium state, and therefore, it is determined that finding of intake air quantity, which makes fuel consumption amount minimum, cannot be performed, and the operational flow goes to a step 310. Then processing is performed so as to give intake air quantity AR(T, N), which is given from a preset map using output torque T and rotational speed N of the internal combustion engine 1, as the target intake air quantity AR*(k). After this, the processing goes through NEXT to terminate this routine. Namely, turning back to the flowchart of FIG. 10, the target intake air quantity AR*(k) is determined assuming that the internal combustion engine is in a transient state.

On the other hand, since the internal combustion engine 1 is regarded as being in equilibrium state when the variables T*(k), T(k) and N(k) are all equal to previous values in step 300, then it is possible to search intake air quantity which makes fuel consumption amount minimum. Then the operational flow proceeds to a step 320. In this step 320, it is determined whether a flag Fs is "1" or not. Since the value of the flag Fs is 0 before searching is started, the determination results in "NO" to proceed to step 330. In step 330, the flag Fs is set to "1", regarding that the searching for intake air quantity actualizing minimum fuel consumption amount is to be started, and a coefficient indicative of searching direction is set to "1" while a counter Cs indicative of the number of times of processings is set to "0".

In a subsequent step 340, it is checked whether the value of the counter Cs has exceeded 0 or not. Since counter Cs=0 immediately after the start of searching, the operational flow goes to a step 350 to vary, i.e increase, the target intake air quatity AR*(k) by D×ΔAR from the previous target value AR*(k−1). In a following step 360, the value of the counter Cs is incremented by 1 to terminate the present routine through NEXT.

After such searching has started, when this routine is executed, the determinations in the steps 320 and 340 both result in "YES". Then the operational flow goes to a step 370 to check how the perturbation components δFR(k) in connection with the fuel injection amount FR(k) relative to the steady-state points are changed in comparison with the perturbation components δFR(k−1) of previous cycle.

When the value of δFR(k)−δFR (k−1) is less than a predetermined value −ΔF, it is regarded that the fuel injection amount is becoming smaller, and the steps 350 et seq. are executed to continue searching. This indicates a situation in FIG. 5 where approaching from point "b" to point "a".

On the other hand, when the value of $\delta FR(k)-\delta FR(k-1)$ is greater than the predetermined vlaue $\Delta F$, it is regarded that the fuel injection amount is increasing, and the value of the searching direction flag D is set to "−1" in a step 380 so as to reverse the searching direction. Then the above-mentioned steps 350 and 360 are executed. Therefore, searching thereafter is performed in a direction of reducing the target intake air quantity AR*(k). This corresponds to searching in a direction from point "c" to point "a" in FIG. 5.

As the searching in a direction of reducing the fuel injection amount is being performed, then a point, at which the value of $\delta FR(k)-\delta FR(k-1)$ is within a given deviation $\pm\Delta F$, will be found. This is the point corresponding to intake air quantity with which fuel consumption amount is minimum with constant output torque. Then, it is regarded that searching is finished, and the flag Fs is set to "0" in a step 390, and in a following step 400 target intake air quantity $AR^*(k-1)$ obtained at this time is replaced with a value of a map which determines intake air quantity from output torque T and rotational speed N, namely, $AR(T, R)=AR^*(k-1)$. In a subsequent step 410, the value of $AR(K-1)$ is renewed because the previously determined target intake air quantity $AR^*(k-1)$ is also used in the present cycle. Then this routine is terminated through NEXT.

One searching process is completed through the above, and then searching is continued from the processing at the beginning and steps 320, 330 and 340.

Figure 11:
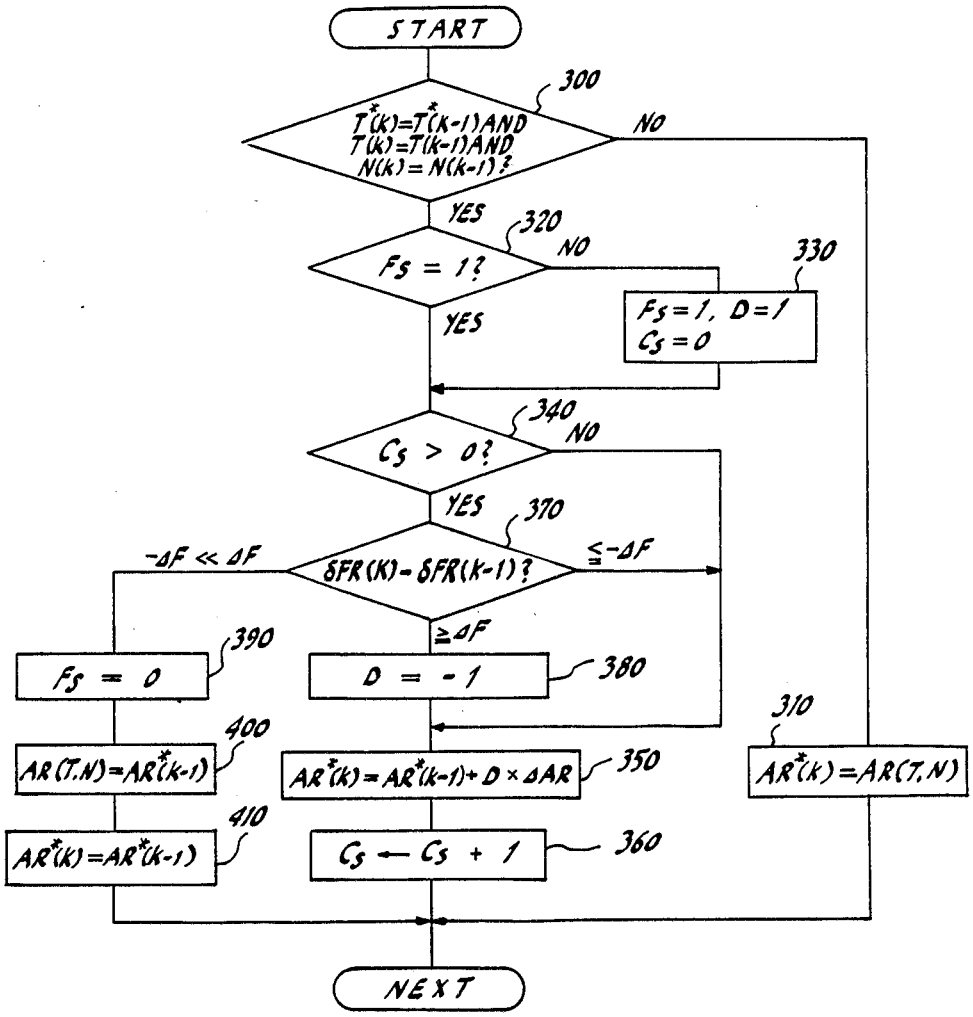
FIG. 11 is a flowchart showing a control routine with which fuel consumption amount is minimized.

As described in the above, by repeatedly executing the control routine of FIGS. 10 and 11 the apparatus for controlling operating state of an internal combustion engine according to the present invention not only controls the operating state of the internal combustion engine 1 to an output torque determined by the depressed stroke of the accelerator 38 and to a rotational speed determined by load at this time, but also operates so as to minimize the fuel consumption amount. At this time, the system controlling the internal combustion engine 1 is an integral-added optimal regulator where the feedback gain gives optimal feedback, while the control of the throttle valve opening degree $\theta$ and the fuel injection amount FR are realized with quick response and stability which were impossible according to the conventional techniques. Accordingly, the driving feeling of the driver of the internal combustion engine 1 is now deteriorated, and it is not possible to minimize the fuel consumption amount FR by changing the throttle valve opening degree $\theta$.

Furthermore, since the dynamic model varies in accordance with the temprature Thw of the coolant of the internal combustion engine 1, the control is performed by switching the parameters of the observer and the optimal feedback gain depending on the coolant temperature Thw and thus it is possible to provide stable control irrespective of the variation of the temperature Thw of the coolant of the internal combustion engine 1.

It is now possible to perform searching for minimizing the fuel injection amount FR of the internal combustion engine 1 because such superior response and stability have been realized for the first time. This is because although searching is possible by driving the throttle valve by the actuator through conventional feedback control, such structure could not be practically used because of poor response and low stability.

Figure 12:
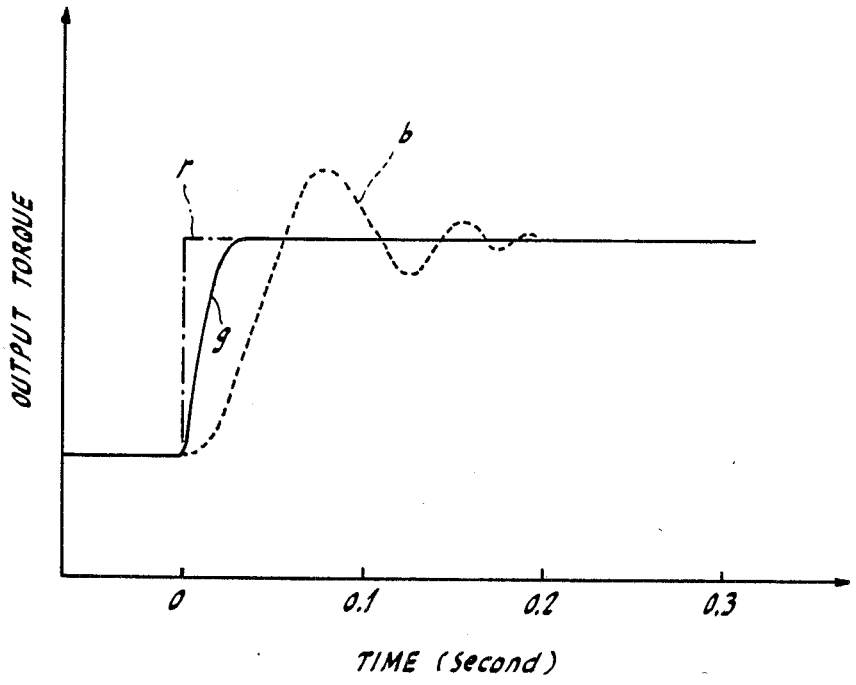
FIG. 12 is a graph for the comparison of the control characteristic between the embodiment and one example of the conventional control.

FIG. 12 shows the above through comparison, and a dot-dash line "r" indicates the target value T*(k) of the output torque; a solid line "g" indicating an example of an output torque obtained when the control according to the present invention is effected, a dotted line "b" indicating an example of an output torque T(k) in the case of performing conventional feedback control. As is clear from the diaram, according to the apparatus for controlling operating state of an internal combustion engine according to the present invention which apparatus is formed as an integral-added optimal regulator, output torque can be controlled with a response (rising) which is quicker than that according to the conventional feedback control without suffering from substantial overshoot and undershoot. Comparing time periods required until the output torque of the internal combustion engine 1 reaches equilibrium state, it is understood that improvement by one or more degrees of magnitude has been attained, and this makes the searching practical with which searching the fuel injection amount is minimized. Therefore, the fuel consumption amount of the internal combustion engine 1 is always controlled to be minimum when viewed macroscopically.

While high response characteristic has been realized, even when the air/fuel ratio of the internal combustion engine 1 varies at the lean side, there would not occur a problem of torque variation since the output torque is stably controlled. Similarly, the problem of lean spike and rich spike has also been resolved. When selecting an appropriate feedback gain F, it is possible to obtain, in the opposite way, rich spike on acceleration and lean spike on deceleration.

While in the above-mentioned embodiment, the internal combustion engine 1 is grasped as a system of two inputs and three outputs because the fuel injection amount FR and the throttle valve opening degree $\theta$ are used as the inputs and the output torque T, the intake air quantity AR, and the rotational speed N are used as the outputs, so as to form the integral-added optimal regulator by constructing dynamic model using system identification through least square method, it is also possible to construct dynamic model of a system considering other inputs and outputs without changing the pitch of the present invention.

As described in detail hereinabove, the apparatus for controlling operating state of an internal combustion engine according to the present invention, a target intake air quantity is determined as a value which makes fuel supply amount minimum on the basis of correlation between intake air quantity and fuel supply amount when output torque is made constant, and its control means is constructed as an integral-added optimal regulator which determines the amount of feedback on the basis of an optimal feedback gain predetermined according to the dynamic model of the system relating to the operation of the internal combustion engine.

Therefore, while high response and stability, which could not be obtained in the conventional internal combustion engine with a throttle actuator, are realized, the ouptut torque of the internal combustion engine is controlled to a target value, and there is a superior advantage that the fuel consumption amount is minimized. Accordingly, when applying to an internal combustion engine of a motor vehicle, it is possible to remarkably improve the control characteristics of the operating state of the internal combustion engine such that the problem of lean spike and rich spike is resolved so as to provide comfortable drive feeling, while the fuel consumption by a motor vehicle is drastically reduced.

The above-described embodiments are just examples of the present invention, and therefore, it will be apparent for those skilled in the art that many modifications and variations may be made without departing from the scope of the present invention.

What is claimed is:

1. An apparatus for controlling an operating state of an internal combustion engine, comprising:

demand amount detecting means for detecting a demand amount, including detecting at least the manipulation amount of an accelerator, as an amount of demand for the operation of said internal combustion engine;

operating condition varying means for varying variable of operating condition, which include at least fuel supply amount and throttle valve opening degree;

operating state detecting means for detecting variables of operating state which include at least intake air quantity, rotational speed and output torque;

target value setting means for determining respective target values for operating state variables which include at least target output torque and target intake air quantity, using said demand amount detected by said demand amount detecting means;

control means for controlling said operating condition varying means by determining feedback amounts of said operating condition variables in order to cause variables of the detected operating state of said internal combustion engine to approach said determined target value;

wherein said target value setting means determines said target intake air quantity as an intake air quantity with which said fuel supply amount becomes minimum on the basis of a correlation between intake air quantity and fuel supply amount when output torque is made constant; and wherein said control means is an integral-added optimal regulator which determines said feedback amount on the basis of an optimal feedback gain predetermined in accordance with a dynamic model of a system relating to the operation of said internal combustion engine, said integral-added optimal regulator of said control means having:

(a) state evaluating means for estimating state variables of an appropriate order indicative of a dynamic internal state of the system based on operating state and operating condition of said internal combustion engine using parameters determined on the basis of the dynamic model of the system relating to the operation of said internal combustion engine;

(b) accumulating means for accmulating respective differences between the target values of the operating state variables determined by said target value setting means and said detected operating state variables, for at least output torque and intake air quantity; and (c) feedback amount determining means for determining respective controlled variables of operating condition including at least fuel supply amount and throttle opening degree which are controlled by said operating condition varying means using said optimal feedback gain determined on the basis of the dynamic model of said system, said estimated state variables, and said accumulated value.

2. Apparatus for controlling an operating state of an internal combustion engine as claimed in claim 1, wherein at least one of: a) the parameters of said state evaluating means and b) the optimal feedback gain of said feedback amount determining means can be switched in response to the change in the dynamic model of the system of said internal combustion engine.

3. Apparatus for controlling an operating state of an internal combustion engine as claimed in claim 2, wherein the switching of said at least one of said parameters and said feedback gain is performed depending on temperature of coolant of the internal combustion engine.

4. Apparatus for controlling an operating state of an internal combustion engine as claimed in claim 3, wherein the switching of said at least one of parameters and feedback gain is performed within a given hysteresis width of the temperature of coolant.

5. Apparatus for controlling an operating state of an internal combustion engine as claimed in claim 1, wherein said target value setting means is also for determining intake air quantity from output torque and rotational speed of said internal combustion engine using a map prepared in advance when determining target intake air quantity, and for determining a target intake air quantity which causes fuel supply amount to be minimum using said intake air quantity as a base.

6. Apparatus for controlling operating state of an internal combustion engine as claimed in claim 5, wherein values of said map are renewed to predetermined target intake air quantities when a predetermined target intake air quantity is different from the value of intake air quantity of said map.

7. Apparatus for controlling an operating state of an internal combustion engine, comprising:

(a) means for detecting an intake air quantity, an output torque, a rotational speed, and a fuel injection amount injected into the internal combustion engine;

(b) target output torque setting means for setting a target output torque using an accelerator opening degree;

(c) target intake air quantity setting means for setting a target intake air quantity as a value which causes a minimum fuel consumption amount using said target output torque from said target output torque setting means, and said intake air quantity, output torque, rotational speed, and fuel injection amount detected by said detecting means;

(d) first and second integrator means for obtaining a first accumulated value by accumulating deviations of said actual output torque from said target output torque, and a second accumulated value by accumulating deviations of said actual intake air quantity from target intake air quantity;

(e) perturbation component extracting means for extracting a perturbation component from various values during a steady operating state of output torque, intake air quantity and rotational speed;

(f) state evaluating means means for obtaining state estimated variables by estimating state variables which represent the internal state of the internal combustion engine using the perturbation component of the condition of operation and the perturbation components of the operating state;

(g) feedback amount determining means for obtaining controlled variables by multiplying the state estimated variables and the above-mentioned accumulated value by the optimal feedback gain; and (h) reference setting value adding means for determining the variables of the operating condition of the internal combustion engine by adding reference setting values corresponding to the steady operating condition to the perturbation components.

* * * * *